United States Patent [19]

Gerspacher et al.

[11] 4,143,209

[45] Mar. 6, 1979

[54] PROCESS FOR MAKING ZINC COATED STEEL WIRE AND PRODUCT MADE THEREBY

[75] Inventors: Michel Gerspacher, Heisdorf, Luxembourg; Albert Cohen, Akron, Ohio

[73] Assignee: The Goodyear Tire & Rubber Company, Akron, Ohio

[21] Appl. No.: 804,430

[22] Filed: Jun. 7, 1977

[51] Int. Cl.[2] ..... B32B 15/06

[52] U.S. Cl. ..... 428/592; 72/47; 428/614; 428/658; 428/677; 428/625

[58] Field of Search ..... 428/381, 389, 658, 677, 428/592, 614; 156/110 C; 427/357; 72/47

[56] References Cited

U.S. PATENT DOCUMENTS

| | | | |
|---|---|---|---|
| 2,870,526 | 1/1959 | Adler | 428/658 |
| 3,729,294 | 4/1973 | Hibbs, Jr. | 428/381 X |
| 3,749,558 | 7/1973 | Dellenschneider | 428/675 |
| 3,762,883 | 10/1973 | Shepard et al. | 428/658 |
| 3,936,536 | 2/1976 | Brock | 428/389 X |

*Primary Examiner*—Michael F. Esposito
*Assistant Examiner*—Evan K. Lawrence
*Attorney, Agent, or Firm*—D. B. Little

[57] ABSTRACT

An improvement in a process for making a rubber adherable wire, wherein a steel wire is plated with brass and then drawn through dies to reach the desired diameter, comprises coating the brass plated wire with $5\times10^{-5}$ to $50\times10^{-5}$ milligrams of zinc per square millimeter of coating surface prior to drawing. The product made by the process is useful for reinforcing rubber articles such as tires.

12 Claims, No Drawings

PROCESS FOR MAKING ZINC COATED STEEL WIRE AND PRODUCT MADE THEREBY

BACKGROUND OF THE INVENTION

This invention relates to processes for preparing articles for use in rubber reinforcement. More particularly, it relates to the preparation and treatment of brass-plated steel wire as reinforcing material for vulcanized rubber articles such as tires.

The problem of securing adequate adhesion of rubber to metal has been investigated extensively by those skilled in the various aspects or rubber manufacturing. The best known reference on this subject, Buchan, *Rubber Metal Bonding* (Crosby, Lockwood & Son, London, 1948) describes the now widespread practice of vulcanization of rubber onto a brass-plated metal substrate. This practice facilitates the drawing of the wire to the very small diameters used in rubber reinforcement, and it helps to assure adhesion of the wire to the rubber mix in which the wires are encased.

It is generally agreed by those skilled in the art that adhesion of rubber to brass-plated steel wire is dependent upon a bond between the copper in the brass and the sulfur in the rubber. The growth of an oxide layer at the surface of the wire is detrimental to good adhesion potential.

The oxide layer in fact begins growing during the wire plating and drawing process. The present invention is directed specifically toward control of surface oxide layer during the plating and drawing process.

A variety of processes for treatment of rubber reinforcing wire are disclosed in the prior art. Coating systems for the wire constitute a significant portion of the prior art in this field. U.S. Pat. No. 3,749,558 describes the coating of steel wire with nickel followed by copper and zinc which are transformed into brass in situ by heating. The nickel is to improve corrosion resistance.

Two patents directed to tire bead wire applications are U.S. Pat. No. 2,870,526 (wire plated with zinc then brass) and U.S. Pat. No. 2,939,207 which discloses wire of a ferrous base coated first with zinc; second, with a thin barrier coating of nickel, cobalt or antimony; and coated thirdly with a rubber adherent material selected from the group copper, copper zinc alloy, copper cadmium alloy, or copper tin alloy.

Canadian Pat. No. 976,858 discloses rubber reinforcing wire plated with brass on top of which there is a second plating of tin or lead, which second coating imparts improved adhesion to the wire.

Two French Pat. Nos. 1,174,055 and 71704 disclose steel wire coated first with zinc, then with copper and finally heat treated.

A method of coating copper plated elements with zinc is disclosed in U.S. Pat. No. 3,597,261. This patent pertains to the coating of copper tubing, in particular, that tubing which is used for automobile brake lines.

Zinc phosphate coatings are discussed in two publications: *WERKSTOFFE und KORROSION* 25 Jahrg. Heft May, 1974, p pages 327–330, the article "Untersuchungen über die Bildung der Zinc-Phosphatüberzüge und ihre Korrosionsschutzeigenschaften" (INVESTIGATIONS ON THE FORMATION OF ZINC-PHOSPHATED COATINGS AND THEIR CORROSION PROTECTION PROPERTIES) by Chr. Kosarev of ZSMK (Central Institute for Corrosion protection of Metals) in Bulgaria and *WIRE WORLD INTERNATIONAL* Vol. 15, 1973, page 104–110, the article "ZINC PHOSPHATE COATINGS FOR FORMED COMPONENTS MADE OF STEEL, ZINC AND ALUMINUM."

SUMMARY OF THE INVENTION

The primary object of this invention is to provide a process for making a rubber adherable reinforcement which when embedded in a vulcanized rubber article demonstrates higher adhesion strength than conventional cords of brass-plated steel wire. Other objects will become apparent as the description proceeds.

The primary object is achieved by coating brass-plated steel wire with a thin layer of zinc prior to drawing the wire to reduce its diameter.

The process of making rubber reinforcing wire normally begins with a raw material of hard carbon steel wire, normally, 0.9 to 1.4 millimeters in diameter and typically comprises the steps of:

1. Cleaning
2. Patenting
   (a) austenitization;
   (b) isothermal cooling;
   Object: to obtain a drawable structure;
3. Pickling or cleaning;
4. Water rinse;
5. Passing the wire through an electrolytic brass coating bath to apply the brass substrate: (a typical electrolytic brass plating process is described in U.S. Pat. No. 2,870,526 at column 2, lines 69 to 72, and column 3, lines 1 to 11 which is incorporated by reference into this application).
6. Water rinse;
7. Drying;
8. Drawing the wire through successive dies until the diameter is decreased generally to between 0.08 and 0.40 millimeters diameter;
9. Twisting the filaments into strands and/or cabling the filaments and/or twisted strands.

Variations of this process are of course possible. For example, the brass coating can be achieved by depositing alternate successive layers of copper and zinc onto the steel wire which can produce brass by migration or mixing between the copper and zinc as taught by Domm U.S. Pat. No. 2,002,261. Heat treatment can be applied to produce a similar result as disclosed in the French patents previously mentioned.

Corrosion protection can be added by coating the steel wire before the brass plating step with nickel or nickel alloy as taught by U.S. Pat. No. 3,749,558. An initial coat of zinc metal prior to brass plating (U.S. Pat. No. 2,870,526) may be used for the same purpose.

A lubricant is generally used in the drawing step to dissipate heat generated in drawing the wire and to lubricate the wire. It can be applied in a number of ways such as spraying or in a bath surrounding both the die and the wire near the die.

In accordance with the provisions of this invention, in between steps 5 and 8 of the procedure given is added the application of zinc to the brass-plated substrate. This is preferably done by electro-deposition, in a suitable electrolytic solution.

The range of zinc deposition considered critical for this invention is from $5 \times 10^{-5}$ to $50 \times 10^{-5}$ milligram zinc per square millimeter of coating surface, i.e. surface of brass-plated wire before drawing. Such a wire will give by an appropriate drawing an outermost coating surface layer 10 Angström thick having a copper content comprised between about 20 and 50 percent in weight.

The process of this invention results in a much improved product. When the reinforcing material of this invention is incorporated into a rubber article which is then vulcanized, there is a marked improvement in the adhesion of the rubber to the reinforcing material in aged samples. Whereas, the adhesive strength of brass plated steel reinforced articles decreased rapidly as age of the article increases, the adhesive strength of articles reinforced with reinforcing material treated by the process herein disclosed remains relatively high.

The improvement over brass-plated steel is even more pronounced when a comparison is made using moist rubber compound. As percent moisture increases the difference in adhesion also increases.

Moisture is present in unvulcanized rubber. It can originate from moisture present in the raw rubber itself or in other compounding ingredients as well as ambient moisture absorbed during storage.

The term "compound" as used herein means the composition of matter formed by combining one or more rubbery polymers selected from the group consisting of natural rubber and synthetic diene rubbers, with conventional compounding ingredients, which ingredients typically include plasticizer, fatty acid, vulcanizing agent, accelerator, age resistors, lubricant and reinforcing filler. Minor amounts of other polymers may be included.

The term "filament" as used herein is defined to be the smallest continuous element of a cord.

The term "wire" as used herein is defined to mean a filament of steel of the single elongated continuous article from which it is produced, whether it has a surface coating or not.

The term "strand" as used herein is defined to mean two or more filaments twisted together.

The term "cable" as used herein is defined to mean two or more strands or filaments twisted together, whether it be around a core or not. In addition, a single filament may be twisted about the cable to form the finished tire cord.

The terms "cord" and "tire cord" as used herein are defined to be generic to the articles for reinforcement. Thus, without being limited thereto, a cord can be a cable, a strand or a single filament as defined hereinabove.

Further evidence of the improved behavior of the zinc-coated material is provided by the fact that it oxidizes at a much lower rate than brass-coated steel.

The reinforcing cord produced from the treated filament prepared by the process disclosed herein can be incorporated in a variety of reinforced rubber articles such as tires, hose, and conveyor belts.

DESCRIPTION OF THE PREFERRED EMBODIMENTS

The process of this invention is useful in the production of reinforcing material for any application wherein the bonding of rubber to brass-plated steel is important. It is particularly advantageous for various reinforcement plies in tires such as tire carcass plies, tire belt, or breaker plies and chippers.

It is preferred that zinc be deposited on the wire by electrodeposition.

The preferred brass substrate plating has a bulk copper concentration of 62.5 to 70 weight percent. Bulk concentration is the average concentration of the constituent metals of the brass.

The optimal zinc deposition is approximately $20 \times 10^{-5}$ milligram zinc per square millimeter of coating surface.

A preferred zinc plating bath composition comprises a water solution of 70 grams per liter of zinc cyanide, 60 grams per liter of sodium cyanide, 100 grams per liter of sodium hydroxide, and 45 grams per liter of zinc.

The preferred diameter of the finished wire after drawing is between 0.15 and 0.26 millimeter.

The following examples are presented not to limit but to illustrate the compounds and methods of this invention. Unless otherwise stated percentages are weight percent.

A brass-plated tire cord process was modified to include the zinc coating step previously described. The wire, after the last brass deposition, was coated with zinc by moving the wire through a zinc cyanide electroplating bath. Current in the bath was 2.5 amps/wire. The wire was 1.3 millimeters in diameter and wire speed was 65 meters per minute. Final filament diameter was approximately 0.25 millimeter.

EXAMPLE 1

Various tests were performed on 5 × 0.25 cords comprised of 5 of these filaments using 5 × 0.25 cords comprised of 5 brass-plated filaments without zinc plating as a control. The method of measuring adhesion was as follows: Test specimens were prepared by curing in a mold a rectangular block of rubber compound with dimensions of 12 mm. × 12 mm. × 75 mm. into which had been embedded two reinforcing cords, one at either end of the block. The mold was so designed that the cords were embedded axially and symmetrically, and insertion length of the cord into the block was always 19 mm. The cords did not go completely through the block nor did they touch each other.

Sufficient cord was left protruding from the ends of the block to allow placement of a sample in the jaws of a tensile tester such as a Scott tester or an Instron tester. The two jaws or clamps of the testing apparatus held the two cord ends. The rubber itself was not held. Force required to pull one of the cords out of the block was measured with a fixed jaw separation rate. The results of this testing are shown in Table 1. The aged samples were aged in an oven at 100° C. in an argon atmosphere.

Samples of different coat compounds have been tested:

Compound A — crude rubber/black
Compound B — crude rubber/black plus resin system
Compound C — crude rubber/black and silica Table I

| | | Adhesion in Kg Pulling Force | | |
|---|---|---|---|---|
| Sample Age: | | 0 | 16 days | 32 days |
| Compound A | Cord of Normal Brass Plated Wire | 31 | 25 | 23 |
| | Cord of Wire with Zinc Top Coat | 32 | 30 | 31 |
| Compound B | Cord of Normal Brass Plated Wire | 35 | 42 | 37 |
| | Cord of Wire With Zinc Top Coat | 39 | 47 | 46 |
| Compound C | Cord of Normal Brass Plated Wire | 35 | 48 | 41 |
| | Cord of Wire With Zinc Top Coat | 39 | 51 | 50 |

The aged adhesion values are significantly better with the cord of zinc top coated wire than with the cord of normal brass coated wire for all tested compounds.

EXAMPLE 2

A similar type of adhesion testing has been performed on samples of cord processed the same as in Example 1, but with varying levels of moisture in the rubber compound. Percent moisture of the unvulcanized rubber compound was determined using a Dupont Analyzer. It may also be determined by gas chromatography and volatilized weight as taught by Canadian Pat. No. 976,858 at page 8, lines 26–28. Samples of the same compounds A, B and C as mentioned in Example 1 have been tested.

The results are given in Table II.

Table II

| Sample % $H_2O$: | | Adhesion in Kg Pulling Force 0.3 | 0.8 | 1.2 |
|---|---|---|---|---|
| Compound A | Cord of Normal Brass Plated Wire | 45 | 20 | 10 |
| | Cord of Wire with Zinc Top Coat | 55 | 56 | 51 |
| Compound B | Cord of Normal Brass Plated Wire | 55 | 31 | 19 |
| | Cord of Wire with Zinc Top Coat | 55 | 52 | 42 |
| Compound C | Cord of Normal Brass Plated Wire | 50 | 29 | 22 |
| | Cord of Wire with Zinc Top Coat | 55 | 43 | 40 |

The cord of zinc top-coated wire maintained its adhesive bond with moist rubber much better than cord of brass-plated steel wire.

EXAMPLE 3

Susceptibility to oxidation was measured on samples of cord wire weighing approximately 50 grams each which were each wound into small coils. In an oven heated at 90° C. under the normal pressure (1 atm) and 98% relative humidity, the samples, carefully weighed before, were exposed for several durations. After 16.30; 34; 53; 119.30; 354 hours in this oven, the samples were weighed again and the measured weight increase per unit brass surface permitted the coating oxidation to be followed. the results appear in Table III:

Table III

| Sample | | Change in Sample Weight (g./square millimeter) $\times 10^9$ 16.30 hrs | 34 hrs | 53 hrs | 119.30 hrs | 354 hrs |
|---|---|---|---|---|---|---|
| 1 | Cord of Normal Brass-Plated Wire with Lubricant 1 | | | 250.0 | 335.0 | |
| 2 | Cord of Normal Brass-Plated Wire with Lubricant 2 | 16.8 | 55.2 | 117.4 | 222.9 | 321.6 |
| 3 | Cord of Wire with Zinc Top Coat with Lubricant 1 | 11.6 | 24.3 | 34.8 | 83.3 | 100.2 |
| 4 | Cord of Wire with Zinc Top Coat and Lubricant 2 | 16.0 | 28.1 | 44.1 | 57.2 | 79.2 |

Table III indicates that regardless of the drawing lubricant the oxidation of the cord of zinc-coated brass-plated wires was much less severe than that of the cords of normal brass-plated wires.

For the 1.3 millimeter diameter wire which has been used as a starting material in the development of this invention, it has been found that the optimal zinc deposition is approximately 0.06 grams zinc per kilogram of wire and the maximal limit is 0.1 grams zinc per kilogram of wire. Over that limit problems occur during drawing.

While certain representative embodiments and details have been shown for the purpose of illustrating the invention, it will be apparent to those skilled in this art that various changes and modifications may be made therein without departing from the spirit or scope of the invention.

What is claimed is:

1. In a process for making a rubber adherable reinforcement wire which includes the steps of (a) plating steel wire with brass so that the brass-plating has a bulk copper concentration of from 62.5 to 70 weight percent and (b) drawing the wire through dies to reach the desired diameter, the improvement which comprises depositing a layer of zinc over the brass before drawing in an amount of $5 \times 10^{-5}$ to $50 \times 10^{-5}$ milligrams zinc per square millimeter of coating surface in order to have, after drawing, an outermost surface layer 10 Angström thick having a copper content comprised between about 20 and 50 percent in weight.

2. The process as recited in claim 1 wherein the zinc is deposited onto the wire by electrodeposition.

3. The process as recited in claim 2 wherein the steel wire before the brass-plating has a diameter of 0.9 to 1.4 millimeters and the drawing step produces a finished wire having a diameter of 0.08 to 0.40 millimeters.

4. The process as recited in claim 3 wherein the drawing step produces a finished wire having a diameter of from 0.15 to 0.26 millimeters.

5. The process as recited in claim 2 wherein the zinc deposition rate is $20 \times 10^{-5}$ milligrams zinc per square millimeter of coating surface.

6. The process as recited in claim 2 wherein the brass-plating is achieved by depositing alternate successive layers of copper and zinc onto the steel wire and causing a migration between the copper and zinc.

7. The process as recited in claim 2 which further comprises the step of coating the steel wire with zinc prior to brass-plating.

8. A rubber adherable steel reinforcement wire made by the process comprising the steps of:

(a) cleaning the wire, (b) patenting the wire, (c) pickling the wire, (d) passing the wire through an electrolytic brass-coating bath to apply brass having a bulk copper concentration of from about 62.5 to about 70 weight percent to the surface of the wire;

(e) rinsing the wire with water, (f) passing the wire through an electrolytic zinc-coating bath to apply from $5 \times 10^{-5}$ to $50 \times 10^{-5}$ milligrams zinc per square millimeter of coating surface;

(g) rinsing the wire with water;

(h) drying the wire; and (i) drawing the wire through successive dies until the diameter is decreased to between 0.08 and 0.40 millimeters in order to have, after drawing, an outermost layer 10 Angström thick having a copper content comprised between about 20 and 50 weight percent.

9. A rubber adherable cord comprising a plurality of wires made by the process of claim 8.

10. A reinforced rubber article in which the reinforcing material is comprised of the cord of claim 9.

11. A pneumatic tire containing the wire of claim 8.

12. A pneumatic tire containing the cord of claim 9.

* * * * *